US005082551A

United States Patent [19]

Reynolds et al.

[11] Patent Number: 5,082,551

[45] Date of Patent: Jan. 21, 1992

[54] HYDROCONVERSION EFFLUENT SEPARATION PROCESS

[75] Inventors: Bruce E. Reynolds, Martinez; Donald A. Bea, Lafayette; Robert W. Bachtel, El Cerrito, all of Calif.

[73] Assignee: Chevron Research and Technology Company, San Francisco, Calif.

[21] Appl. No.: 560,223

[22] Filed: Jul. 25, 1990

Related U.S. Application Data

[63] Continuation of Ser. No. 236,576, Aug. 25, 1988, abandoned.

[51] Int. Cl.[5] ..... C10G 67/02; C10G 49/22

[52] U.S. Cl. ..... 208/100; 208/102; 208/103; 208/112

[58] Field of Search ..... 208/100, 102, 103, 105, 208/340

[56] References Cited

U.S. PATENT DOCUMENTS

| | | | |
|---|---|---|---|
| 3,471,398 | 10/1969 | Borst, Jr. | 208/100 X |
| 3,598,720 | 8/1971 | Stolfa | 208/100 |
| 3,607,726 | 9/1971 | Hallman | 208/103 X |
| 4,159,937 | 7/1979 | Scott | 208/100 |
| 4,457,834 | 7/1984 | Caspers et al. | 208/102 X |
| 4,673,488 | 6/1987 | Turner et al. | 208/103 |
| 4,925,573 | 5/1990 | Vorlow | 208/100 |

*Primary Examiner*—Anthony McFarlane
*Attorney, Agent, or Firm*—Burns, Doane, Swecker & Mathis

[57] ABSTRACT

A hydroconversion effluent separation process is provided.

The effluent from the hydroconversion zone is passed to a hot high pressure separation zone. The gas phase from that zone is then passed to a cold high pressure separation zone while the liquid hydrocarbon bottoms is passed to a hot low pressure separation zone. The gas phase is partially condensed in the cold high pressure separation zone to obtain a hydrogen-rich gas and a liquid hydrocarbon bottoms. A portion of the hydrogen-rich gas is recycled to the hydroconversion zone. A second portion is sent to a hydrogen purification step, most preferably by membrane separation, and the purified gas is recycled to the hydroconversion zone. The overhead from the hot low pressure separation is fed to a cold low pressure separation zone. The gas phase from the cold low pressure separation zone is recycled to the hydroconversion zone. Preferably, two cold low pressure separation zones are utilized in the process.

9 Claims, 1 Drawing Sheet

HYDROCONVERSION EFFLUENT SEPARATION PROCESS

This application is a continuation of application Ser. No. 236,576, filed Aug. 25, 1988, now abandoned.

BACKGROUND OF THE INVENTION

The invention relates to a hydroconversion effluent separation process wherein multiple hot and cold temperature and high and low pressure separators are used and wherein net hydrogen loss is low.

The term "hydroconversion" is used here to connote a process which consumes hydrogen and converts a hydrocarbonaceous feed, such as petroleum or a petroleum fraction, to a hydrocarbon product. Example hydroconversion processes include hydrofining, hydrotreating and hydrocracking. The term "hydroconversion" is more particularly defined hereinbelow. The present invention is particularly directed to high pressure hydroconversion processes wherein the hydroconversion reaction zone is operated at a pressure above 500 psig. Further, the present invention is particularly directed to hydroconversion processes wherein hydrogen-rich gas is recycled to the hydroconversion reaction zone.

In hydrofining, hydrotreating and hydrocracking reactions, an oil or other hydrocarbonaceous feed is upgraded by chemical reactions carried out in the presence of hydrogen gas. Hydrofining is the mildest of these three types of hydroconversion processes. The term "hydrotreating" is generally applied to more severe hydroconversion processes than hydrofining, but often is used in a broad sense to include hydrofining. Typical hydrotreating reactions include desulfurization of oil feeds and also denitrification. Heavy oil desulfurization is an important hydroconversion process and the process of the present invention is advantageously applied to such process. The term "hydrocracking" is generally used for more severe processes wherein more cracking of the oil feed occurs. However, there is not a sharp dividing line between these three types of hydroconversion processes. All three of these types of processes are well known and described in the literature, see, for example, Kirk-Othmer, Encyclopedia of Chemical Technology, Third Edition, Vol. 17, pages 201-206 and Vol. 3, page 335.

The principal chemical reactions that occur in hydroconversion processes are cracking, hydrogenation, denitrification, desulfurization, demetalation and isomerization. These reactions are typically carried out by contacting a mixture of hydrogen and the feed hydrocarbons with a catalyst contained in one or more reactors at temperatures of 400° F. to 850° F. and pressures of 500 to 5000 psig.

The effluent from the hydroconversion reactor contains unreacted hydrogen, converted and unconverted hydrocarbonaceous materials (mainly hydrocarbons but often also small amounts of organic sulfur and/or nitrogen compounds), and product gases. The product gases include light hydrocarbons and contaminant gases, such as $H_2S$ and $NH_3$, generated by the hydrogenation of sulfur and nitrogen. In broad terms, the hydroconversion reactor effluent is separated into a hydrogen-rich gas phase that is recycled to the hydroconversion reaction zone and a liquid phase that, after fractionation, may be used as a feed to further hydroconversion processes or as a feed to fluid catalytic cracking, or, especially in the case of hydrocracking, may be fractionated into liquid products, such as light naphtha, heavy naphtha, jet fuel, and diesel fuel.

The initial separation of the hydroconversion reactor effluent has normally been done by cooling the reactor effluent to temperatures that provide a gas phase with a hydrogen content suitable for recycle after removal of contaminants such as hydrogen sulfide. While such separation is an effective way to recover much of the hydrogen in the reactor effluent, it has poor energy efficiency in that a significant fraction of the heat energy in the effluent is lost. Also hydrogen losses generally are considerable.

Separation of the reactor effluent at higher temperatures has been used to improve the energy efficiency of the overall hydroconversion/separation process. Separation at higher temperatures may, however, result in a gas phase that is too hot or not sufficiently rich in hydrogen for recycle. Also, the liquid phase from a high temperature separation will contain more dissolved hydrogen, thereby increasing the net hydrogen loss of the process.

U.S. Pat. No. 4,457,834 discloses a process for separating the effluent from a hydroconversion reaction zone. According to U.S. Pat. No. 4,457,834, the recycle hydrogen is separated from effluent comprising hydrogen and hydrocarbons by a sequence of steps which includes: (a) passing the effluent to hot high pressure separation to obtain a liquid and a gas phase; (b) pressure reduction on both the liquid and gas phases to low pressure; (c) passing the lower pressure liquid phase to hot low pressure separation; (d) cooling the combined gas phases from steps (a) and (c); (e) passing the combined cooled stream to cold low pressure separation; (f) passing the liquid phase from step (e) to fractionation to obtain product hydrocarbon and passing the gas phase from step (e) to hydrogen sulfide removal to obtain purified hydrogen; (g) passing purified hydrogen to pressure swing adsorption for further hydrogen purification; (h) compressing the low pressure purified hydrogen from step (g) and recycling the compressed hydrogen to the hydroconversion reactor. In the process of U.S. Pat. No. 4,457,834, although much of the hydrogen dissolved in the liquid from the hot high pressure separator is recovered for recycle, the recycle hydrogen requires considerable energy input for compression, since all the recycled hydrogen in the '834 process derives from a low pressure separator.

The use of membranes to separate hydrogen from other gases has been disclosed in various references, such as "Separation Systems For Oil Refining and Production", W. A. Bollinger et al, Chem. Engr. Progress, October 1982, page 27; "High Hydrogen Purity Is Key in New Refining Era", E. A. Maciula, Oil and Gas Journal, May 1980, page 63; "Is Permeation Competitive?", R. C. Schendel et al, August 1983, page 58; "Du Pont Membrane System Recovers Hydrogen", Chem. and Engr. News, Apr. 14, 1986, page 24; U.S. Pat. No. 4,398,926; "Enhanced Hydrogen Recovery From Low Purity Gas Streams", August, 1983; U.S. Pat. No. 4,362,613; "Hydrocracking Processes Having an Enhanced Efficiency of Hydrogen Utilization", December, 1982; and "Optimizing Hydrocracker Hydrogen", W. A. Bollinger et al, Chem. Engr. Progress, May 1984, page 51.

The "Optimizing Hydrocracker Hydrogen" article discloses a hydrogen separation system for use in conjunction with a hydrocracking reaction. Effluent from the hydrocracker is cooled and passed to a high (1800 psig) pressure separator where hydrogen is separated for recycle and liquid hydrocarbons are withdrawn for passage to a low pressure separator. Since the hydrogen is recycled, the temperature in the high pressure separator is likely to be in the area of 120° F. (cold high pressure separation to obtain reasonable purity of hydrogen for recycle). The recycle hydrogen is brought back to the hydrocracker via a recycle compressor. A portion of the hydrogen from the high pressure separator is withdrawn from the recycle loop as a high pressure purge stream. The high pressure purge stream is passed to a membrane separation unit "Prism separator" for recovery of high purity hydrogen from the purge stream.

A system such as described in the "Optimizing Hydrocracker Hydrogen" article cannot successfully be used in residua hydrotreating. Amongst other factors, a water wash would be needed ahead of the cold high pressure separator and this would not operate satisfactorily because of emulsion formation and foaming.

SUMMARY OF THE INVENTION

According to the present invention, a process is provided for separating gases from a hydroconversion reaction zone effluent. The process comprises:

(a) effecting a hot high pressure separation of the effluent by reducing the temperature of the effluent to produce a first gas phase comprising hydrogen, contaminant gases, and gaseous hydrocarbons and a first liquid phase comprising liquid hydrocarbons, and separating the first gas phase from the first liquid phase;

(b) effecting a cold high pressure separation of the first gas phase by reducing the temperature of the first gas phase to form a first hydrogen-rich gas and a second liquid phase, and separating the second liquid phase from the first hydrogen-rich gas;

(c) effecting a hot low pressure separation of the first liquid phase by reducing the pressure of the first liquid phase to form a second gas phase comprising hydrogen and gaseous hydrocarbons and a third liquid phase comprising hydrocarbons; and separating the second gas phase from the third liquid phase;

(d) effecting a cold low pressure separation of the second gas by reducing the temperature thereof to form a second hydrogen-rich gas and a fourth liquid phase comprising hydrocarbons, and separating the fourth liquid phase from the second hydrogen-rich gas;

(e) recycling the second hydrogen-rich gas to the hydroconversion zone;

(f) recycling a first portion of the first hydrogen-rich gas to the hydroconversion zone;

(g) purifying a second portion of the first hydrogen-rich gas to obtain a purified hydrogen-rich gas of at least 95 percent hydrogen; and (h) recycling the purified hydrogen-rich gas to the hydroconversion zone.

Preferably, the step (g) purification is carried out by pressure swing adsorption or by membrane separation to obtain purified hydrogen-rich gas. Membrane separation is especially preferred.

Among other factors, the present invention is based on our finding that an unexpectedly large reduction in hydrogen gas losses is achieved using the process of the present invention. In our process a first gas is separated from hydroconversion effluent in a hot high pressure separation zone; a first hydrogen-rich gas is separated from the first gas in a cold high pressure separation zone; a first portion of the first hydrogen-rich gas is recycled to the hydroconversion zone and a second portion is purified to high purity and then recycled to the hydroconversion zone; the liquid from the hot high pressure separation is passed to a hot low pressure separation zone wherein a second gas is separated from a liquid; the second gas is passed to a cold low pressure separation zone wherein a second hydrogen-rich gas is separated; and the second hydrogen-rich gas is recycled to the hydroconversion zone.

Preferably, two cold low pressure separation zones are used, as described in more detail below.

In our process, we have found that particularly good results are achieved, in terms of hydrogen recovery efficiency and heat availability for fractionation of product hydrocarbons from the hydroconversion zone, when the hot high pressure separator is operated at about 700° F., particularly when hydrodesulfurization of a heavy oil is carried out in the hydroconversion zone. Thus, according to a preferred embodiment of the present invention, hydrodesulfurization is carried out in the hydroconversion zone, the feed to the hydroconversion zone is a heavy oil boiling mostly above 650° F., the hydroconversion zone is operated at a temperature above 700° F., and the hydroconversion reaction zone effluent is cooled to a temperature between 650° F. and 750° F., more preferably 675° to 725° prior to separating the first gas from the first liquid phase.

According to the present process, the hydrogen-rich gas from step (b) is obtained at a pressure relatively close to the hydroconversion zone outlet pressure, as the step (b) separation is carried out at high pressure. This is an important aspect of the present process and this aspect is integrated into the overall process of the invention.

The pressure difference between the hydroconversion reactor outlet and the separation zone for step (b) will be a function of pressure drop in heat exchangers, piping and the like, as indicated in more detail hereinbelow. Preferably, the pressure drop between the hydroconversion reactor outlet and separation step (b) is no more than 150 psi, more preferably no more than 100 psi, and most preferably no more than 50 psi.

As indicated above, the hydrogen-rich gas from the cold high pressure separation step (b) is recycled to the hydroconversion zone. It should be understood that in many instances the hydrogen-rich gas from the cold high pressure separation will not be recycled "as is", but may first be subjected to purification to remove contaminants, such as hydrogen sulfide and/or ammonia.

It is important in the process of the present invention to purify a second portion of the first hydrogen-rich gas prior to recycle, preferably to a purity level of at least 95 percent hydrogen. Particularly preferred means in our process for such purification is membrane separation.

According to a preferred embodiment of the present invention membrane separation is used to purify a portion of the hydrogen recycle gas and provide a high purity hydrogen stream for recycle, and the inlet pressure to the membrane separation step is at high pressure, preferably between 750 and 5,000 psig, more preferably between 750 and 3,000 psig, so that the outlet from the membrane separation step can be brought to hydroconversion zone operating pressure by use of the make up compressor. The make up hydrogen compressor, which brings hydrogen from relatively low pressures of between about 50 and 400 psig up to between 750 and 5,000 psig, more preferably, between 750 and 3,000 psig, is usually a reciprocal (piston/cylinder) compressor.

We have found that the process of the present invention is particularly advantageously applied to hydrotreating or desulfurization. Hydrotreating generally involves desulfurization, denitrification and mild hydrocracking.

According to a hydrotreating or desulfurization embodiment of the present invention, preferably hydrogen sulfide is removed from the hydrogen-rich gas from the cold high pressure separation step prior to recycling such gas to the hydrotreating reactor or reaction zone. Preferred purity levels for the hydrogen-rich gas from the cold high pressure separator is at least about 75% by volume, more preferably at least 85% by volume, and preferred purity for this hydrogen-rich gas stream after hydrogen sulfide removal is at least about 80% by volume, more preferably at least about 92% by volume.

According to the present invention, especially in a hydrotreating process embodiment, preferred hydrogen-rich gas purity from the cold low pressure separator is at least 75% hydrogen by volume, more preferably at least 80% by volume.

Preferred temperatures and pressures for the process of the present invention include: a temperature for the hydroconversion zone reaction effluent of between about 700° F. and 950° F. and a pressure between about 750 and 5,000 psig; cooling the effluent to a temperature between about 400° F. and 750° F. in the step (a) hot high pressure separation; cooling the first gas phase from step (a) to a temperature between about 90° F. and 200° F. in the step (b) cold high pressure separation; reducing the pressure of the first liquid phase from step (a) to a pressure between about 100 psig and 1000 psig in the step (c) hot low pressure separation; and reducing the temperature of the second gas from step (c) to between about 90° F. and 200° F. in the step (d) cold low pressure separation. Preferably, the pressure in the cold low pressure separation step (d) is 20 to 500 psig lower than the pressure at which separation is effected in the hot low pressure separation step (c).

According to a preferred embodiment of the present invention, two cold low pressure separation zones are used. We have found that this improves overall efficiency of the process. In this embodiment, the process comprises, in addition to steps (a) through (h) mentioned above, the further step (i): effecting a second cold low pressure separation by reducing the pressure of the second liquid phase to form a third gas phase comprising contaminant gases and gaseous hydrocarbons, and a fifth liquid phase comprising hydrocarbons; and separating the third gas phase from the fifth liquid phase.

In this preferred embodiment utilizing two cold low pressure separation zones, the second gas from the step (c) hot low pressure separation zone is passed to the first cold low pressure separation zone in accordance with step (d) and the second liquid, which is the liquid phase from the cold high pressure separation zone of step (b), is passed to the second cold low pressure separation zone [CLPS(2)] in accordance with step (i).

Preferred operating conditions for the embodiment utilizing these two cold low pressure separation zones include reducing the temperature of the second gas from step (c) to a temperature between about 90° F. and 200° F., more preferably between about 100° F. and 150° F., in the step (d) cold low pressure separation zone; reducing the pressure on the second gas from step (c) by about 10 to 200 psig in the step (d) separation zone, to a pressure between about 90 and 990 psig; utilizing approximately the same temperature in the second cold low pressure separation step [step (i) separation] as in the cold high pressure separation step (b), namely, between about 90° F. and 200° F., more preferably between 100° F. and 150° F.; but reducing the pressure on the liquid from the step (b), cold low pressure separation by about 200 to 4950 psi in the step (i) separation zone, to a pressure between about 50 psig and 500 psig. In this preferred embodiment, preferably the step (d) cold low pressure separation is carried out at 100 to 500 psi higher than the pressure for the step (i) cold low pressure separation.

Particularly preferred temperature and pressures for the separation in the preferred five separation zones embodiment are as follows for a heavy oil hydrotreating operation wherein the reactor effluent is at about 700° F.-900° F., 1,500-3,000 psig.

| | | |
|---|---|---|
| hot high pressure separation: | 650°-750° F.; | 1,500-3,000 psig |
| cold high pressure separation: | 100°-140° F.; | 1,500-3,000 psig |
| hot low pressure separation: | 650°-750° F.; | 250-500 psig |
| cold low pressure separation: | 100°-140° F.; | 75-200 psig |
| cold low pressure separation (2): | 100°-140° F.; | 200-500 psig |

DETAILED DESCRIPTION OF THE INVENTION

Figure 1:
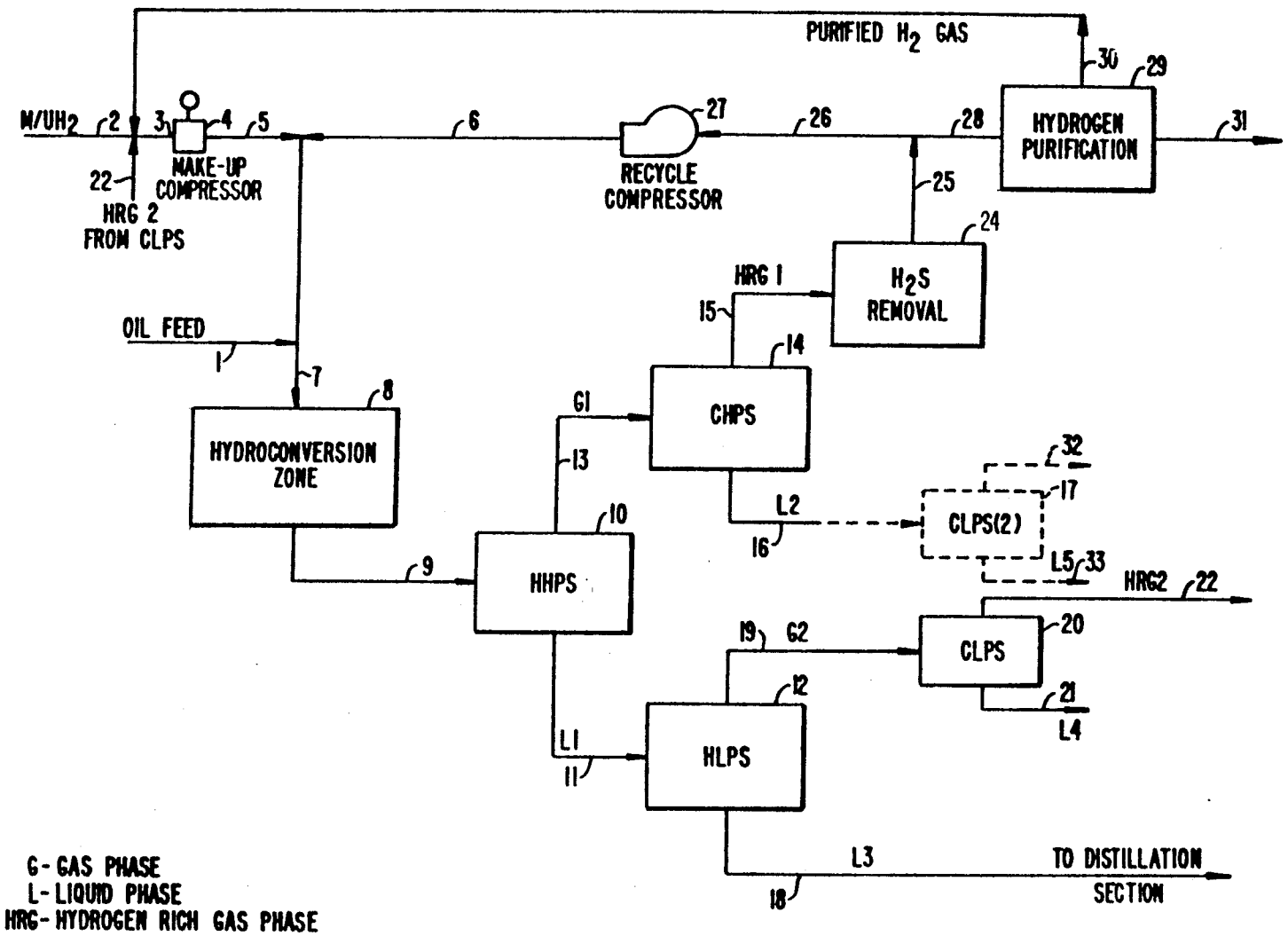
FIG. 1 is a schematic flow diagram illustrating a preferred embodiment of the present invention.

As used herein, the term "contaminant gases" means the gases included in the effluent that were generated in the hydroconversion process, for example, by the hydrogenation of organic sulfur and/or nitrogen, in the liquid hydrocarbon feedstock to the hydroconversion process. Such gases thus include hydrogen sulfide and ammonia.

As used herein, the term "normal boiling" means boiling temperature under atmospheric pressure. Unless otherwise indicated, boiling temperatures given herein are normal boiling temperatures. Boiling ranges can be determined by ASTM D-86 method for light feedstocks, such as light gas oil and lighter, and by ASTM D-1160 method for heavy gas oil and heavier feedstocks. Normal boiling ranges for gasoline are about 200° F. to 400° F., for light gas oil about 300° F. to 700° F., for heavy gas oil about 650° F. to 1000° F. and for reduced crude and vacuum residuum, about 650° F. plus and 1000° F. plus, respectively. Unless otherwise stated, boiling ranges are in terms of 10% cut point to 90% cut point.

The term "hydroconversion" is used here to connote a process which consumes hydrogen and converts a hydrocarbonaceous feed, such as petroleum or a petroleum fraction, to a hydrocarbon product. Example hydroconversion processes include hydrofining, hydrotreating and hydrocracking. Example feeds include gasoline and light gas oil boiling range hydrocarbons, and heavy oils, such as heavy gas oil, reduced crude, vacuum distillation residua, and solvent deasphalted residua.

The hydroconversion reaction effluent that is separated according to the invention will usually be a two-phase mixture of gas and liquid, although in some embodiments it may be entirely vapor. The gas phase will normally comprise hydrogen, $C_1$-$C_4$ hydrocarbons, and contaminant gases, whereas the principal components of the liquid phase are $C_5$ hydrocarbons and higher.

Referring to FIG. 1, feed is introduced to the process via line 1. The feed may be any of various hydrocarbonaceous feeds, although typical feeds for hydrocracking or hydrotreating are preferred. Preferred feeds are gas oils boiling from about 400° F. to 1000° F., reduced crudes boiling from about 600° F. upward, vacuum residua boiling from 700° F. upward, and solvent deasphalted residua boiling from 600° F. upward. The present process is especially advantageously applied to hydrotreating or hydrodesulfurization of heavy oils boiling from 400° F. upward and residua boiling from 700° F. upward.

Make up, or net hydrogen feed, is introduced via line 2 and combined with recycle gas and fed via line 3 to make up compressor 4 where the hydrogen is brought up to feed pressure for the hydroconversion zone. The hydrogen is typically brought into a hydrotreating or hydrodesulfurizing process at about 150 to 350 psig in line 2 and increased to between 750 and 10,000 psig in line 5, more typically to between 1,000 and 4,000 psig. The pressurized hydrogen in line 5, recycle hydrogen in line 6, and the hydrocarbonaceous feed in line 1 are combined and passed via line 7 to hydroconversion zone 8. As the drawing is simplified, many components are omitted, such as heaters generally used to bring the feed up to hydroconversion zone inlet temperature.

The severity of the hydroconversion temperature, pressure and other reaction conditions will vary depending on the feed, the extent of conversion desired and the particular catalyst, if any, employed in the reaction zone. Various hydroconversion reactions may be carried out in the reaction zone, including hydrofining at relatively mild conditions of 600° F. to 850° F. and 500 to 1000 psig, hydrotreating at 600° F. to 850° F. and 800 to 2000 psig, and hydrocracking at 600° F. to 900° F. and 1000 psig to 5000 psig. However, low pressure hydrogenation reactions, that is, hydrogenation of chemical feeds at pressure below 500 psig are not contemplated within the scope of the present process.

The hydroconversion reactor effluent is passed from hydroconversion zone 8 via line 9 into a hot high pressure gas-liquid separation zone 10. The temperature of the effluent is reduced while its pressure typically is substantially maintained. For instance, if the effluent temperature is about 700° F.-900° F., it will be reduced to about 675° F. to 725° F., in accord with a preferred embodiment of the present invention, before being passed via line 11 to hot low pressure separation zone 12. In terms of equipment, zone 10 will include means for cooling the effluent and separating the resulting gas and liquid phases. Conventional equipment, such as heat exchangers and one or more high pressure separator vessels, may be used. The overhead (gas phase) from the zone is comprised predominantly of hydrogen, contaminant gases, and, in a typical hydrotreating application, hydrocarbons normally boiling in the diesel range and below. In a preferred vacuum residua desulfurization application, the hydrogen will normally constitute at least about 70% by volume of the gas phase. The bottoms (liquid phase) from the zone is comprised mostly of hydrocarbons normally boiling above the diesel range. It will, of course, also include minor proportions of all the other components of the reactor effluent, including dissolved gases.

The overhead from the hot high pressure separation zone is passed via line 13 to a cold high pressure zone 14 where its temperature is further reduced, for example, to between about 100° F. and 140° F. in a typical hydrotreating or hydrodesulfurization application. The pressure in this zone typically is substantially the same as in the hot high pressure separation zone, except for pressure losses due to piping, heat exchangers and the like. The further temperature reduction partially condenses the overhead. Conventional high pressure separation equipment may be used in this zone. The uncondensed portion of the overhead is a hydrogen-rich gas product, for example, in a preferred vacuum residuum hydrotreating application, it is composed of at least about 80% by volume of hydrogen, more usually at least about 90% by volume. It is removed from the zone as an overhead stream via line 15. Depending on the process, the level of purity of stream 15 may be high enough to be used directly as recycle to the hydroconversion zone.

In typical hydrotreating or hydrodesulfurization processes, stream 15 will contain hydrogen sulfide and possibly other contaminant gases, such as ammonia, which preferably are removed prior to recycle to hydroconversion zone 8. Such contaminants can be removed by known processes. For example, an amine solvent can be used in zone to remove hydrogen sulfide from the recycle hydrogen-rich gas obtained from the cold high pressure separation step. Water scrubbing can be used for ammonia removal from the recycle hydrogen.

The liquid phase hydrocarbons from zone 14 are drawn off via line 16 and passed to distillation, or, according to the dotted alternate shown in FIG. 1, passed to cold low pressure separation (2), which is zone 17. The pressure of the liquid hydrocarbons withdrawn from zone 14 is reduced prior to zone 17, or in zone 17.

Referring back to the first separation zone, the liquid phase hydrocarbons from the hot high pressure separation zone 10 are removed from zone 10 via line 11 and passed to hot low pressure separation zone 12. In zone 12, the pressure is reduced while the temperature is preferably maintained at substantially the same temperature at which separation is effected in the hot high pressure zone. The pressure reduction flashes a portion of the liquid charge to zone 12, so that a gas phase is obtained.

In terms of equipment, zone 12 will generally include conventional pressure reduction devices, such as pressure reduction valves and/or one or more separator or flash drums. Preferably, zone 12 also includes the use of a power recovery turbine to recover power from the pressure reduction from zone 10 to zone 12.

Hydrocarbon liquid is passed via line 18 from zone 12 to further processing, such as by fractionation into final products or products to be further refined. Stream 18 contains the heavy (high boiling) liquid product from the separation process and generally comprises hydrocarbons boiling above the diesel range (i.e., above about 600° F.).

The gases that are flashed off or separated in zone 12 include most of the gases that were dissolved in the liquid phase withdrawn via line 11 from zone 10. These gases are comprised predominantly of hydrogen, contaminant gases, and hydrocarbons boiling in the gasoline range and below (i.e., below about 300° F.-400° F.). The gases are taken off as an overhead from zone 12 via line 19 and carried thereby to cold low pressure separation zone 20. Prior to zone 20, or in zone 20, the gases from zone 12 are cooled. The gases from zone 12 are passed to zone 20.

The overhead from the hot low pressure separation zone is separated into a gas phase and a liquid phase in zone 20. Zone 20 may include conventional temperature and pressure reducing means. The temperature reduction results in a liquid hydrocarbon bottoms stream, typically comprised mostly of hydrocarbons boiling in the gasoline and diesel range with minor amounts of heavier and lighter hydrocarbons. The uncondensed gases, on the other hand, are mostly hydrogen with minor amounts of contaminant gases and $C_1$-$C_4$ hydrocarbons. The liquid phase hydrocarbons are passed from zone 20 via line 21 to further processing, such as by fractionation into final products or products to be further refined.

The overhead gases from the cold low pressure separation zone 20 are removed therefrom by line 22 and may be recycled to hydroconversion zone 8 via line 22 and the make up compressor 4, etc.

Another portion of the hydrogen-rich gas stream is passed via line 28 to hydrogen purification zone 29. In zone 29 the hydrogen stream is purified, preferably to a hydrogen content of at least 95 percent hydrogen by volume Purified hydrogen is recycled to hydroconversion zone 8 via line 30 and compressor 4. The portion of the recycle hydrogen gas drawn off for purification in zone 29 preferably is between 1 and 25 percent, more preferably between 2 and 15 percent of the total recycle stream 25.

Preferred means for affecting hydrogen purification in zone 29 include pressure swing adsorption, and/or membrane separation.

Pressure swing adsorption operates to purify the gases by removing contaminant gases and hydrocarbons. Pressure swing adsorption systems are well known. They operate by selectively adsorbing the impurities from the gas. Desorption and regeneration of the adsorbent are accomplished by reducing the adsorptive capacity of the adsorbent by lowering the pressure and purging the adsorbent with an inert gas. Pressure swing adsorption allows more rapid sorption-desorption cycling than is possible in thermal swing adsorption.

A pressure swing cycle consists of: adsorption; depressurization; purge at low pressure; and repressurization. This cycle may be carried out using two or more beds of an adsorbent that are capable of selectively adsorbing impurities, such as methane, from a hydrogen-rich gas. Such adsorbents include molecular sieves, particularly zeolitic molecular sieves, silica gel, activated carbon, and mixtures thereof. The most efficient systems operate with more than two beds with one or more of the beds undergoing regeneration while the others are adsorbing. The depressurization gas is used as much as possible to purge and repressure other beds.

The purified hydrogen gas product is taken from the pressure swing adsorption system via line 30. As indicated above the hydrogen content of this product preferably is at least about 95% by volume, more preferably at least 97% by volume, most preferably at least 99% by volume. It will typically be at substantially the same pressure as the impure gas entering the system, since there is usually very little pressure drop for the hydrogen through the pressure swing adsorption system for the hydrogen. The impurities leave the system by an "other gas" line 31. They will typically exit the system at pressures ranging between atmospheric pressure and about 150 psig. The pressure of the removed gases is typically an important operating parameter of pressure swing adsorption systems. As a general rule, the lower this pressure, the higher the hydrogen recovery from the feed gas. Typically, the ratio of feed gas pressure to removed gas pressure will be maintained at about 4:1 or higher.

In the process of the present invention, we have found that membrane separation of purified hydrogen for recycle via line 30 provides particularly advantageous results in terms of hydrogen savings and other operating advantages, including overall process reliability. Membrane separation technology is well known and is described in references such as those previously cited, and also in "Membrane Separation Technology" by D. J. Stookey et al. AIChE 1986 Spring National Meeting, Apr. 8, 1986; and in Kirk-Othmer Encyclopedia of Chemical Technology, Third Edition, Vol. 15, pages 92–130. The disclosure of the aforesaid references are incorporated herein by reference.

The term membrane separation is used herein to refer to separation wherein the gas to be separated (in this case, hydrogen) diffuses across the thickness of the membrane more selectively than the gases (such as methane) from which the hydrogen is to be separated. The purified hydrogen is withdrawn from the membrane on the side opposite to which the unpurified hydrogen gas first contacts. The membrane separation involves hydrogen (the permeate) molecules passing into the membrane at its upstream surface followed by molecular diffusion down a hydrogen concentration, fugacity or partial pressure gradient to the downstream surface of the membrane. There the purified hydrogen is carried off in the purified hydrogen stream for recycle to the hydroconversion unit via line 30. The rejected gases, typically rich in methane, are withdrawn via line 31 for processing elsewhere.

Preferred mechanical configuration for the membrane separation units are much like shell and tube heat exchangers, with the membranes in the shape of hollow fibers or tubes. The feed gas to be purified enters a unit on the "shell-side", hydrogen preferentially permeater hollow fibers or "tubes" of membrane and is withdrawn from the tube side of the unit. The impurities, such as methane and other light hydrocarbon gases, do not permeate the membrane to a substantial extent (less than 10 volume percent of the light hydrocarbon gases permeate under preferred operating conditions) and thus the impurities are withdrawn on the shell-side of the unit. A shell and tube type configuration of a membrane separation unit is shown in the W. A. Bollinger et al, article "Separation Systems for Oil Refining and Production", previously cited herein.

Preferred membranes for use in the preferred membrane separation step of the present invention are formed from organic polymers and are solid at the temperatures of use. The polymeric membrane can be in the form of a natural polymer such as cellulose, but preferably a synthetic polymer is used. The chemical structure of the polymers range from hydrocarbons (like polyethylene or polypropylene) to polar structures (like polyamides). Preferably the membrane is in the form of a dense film, shaped into a hollow tube or fiber. Membrane separation units are commercially available for accomplishing the desired separation of hydrogen from the impurities present in gas stream 28. The Prism separators marketed by Monsanto Company are examples of such units that are advantageous for use in the practice of the present invention. Such separators contain a gas permeable membrane capable of selectively permeating hydrogen at a separator feed gas pressure in excess of about 500 psig, commonly up to about 1,500 psig or higher. Inlet means are provided for passing a hydrogen-containing feed gas at said pressure to the feed inlet portion of the separator. Outlet means are provided for withdrawing hydrogen-rich permeate gas from the separator at a reduced pressure. Other outlet means are provided for separately withdrawing the non-permeate portion of the gas stream, i.e., the portion not passing through the membrane, from the separator essentially at the feed gas pressure. In the commercially available embodiments, the permeable membrane comprises hollow fibers, commonly made from polysulfonate material, and assembled within the separator structure. The Prism separators referred to above include such hollow fibers assembled into compact bundles to provide a large membrane area available for passage there through of the hydrogen being separated from impurities present in the feed gas. The feed inlet portion of the separator and the non-permeate gas outlet means are conveniently in fluid communication within the separator on the outside of the hollow fibers. The permeate gas outlet means are then in fluid communication with the inside of the hollow fibers. In practical, convenient embodiments, the non-permeate gas outlet means and the permeate gas outlet means are at opposite ends of the separator, with the feed inlet means being positioned near the permeate gas outlet means. In operation, the pressurized feed gas enters the separator, and hydrogen selectively permeates the hollow fiber walls. The purified hydrogen-rich permeate gas passes through the interior of the fiber bores at reduced pressure and is delivered to its outlet means at one end of the separator, while non-permeate gas passes to the outlet means for such gas typically at the opposite end of the separator.

Preferred membrane materials and configurations for use in the present membrane separation step are disclosed in U.S. Pat. No. 4,362,613, cited above. The disclosure of U.S. Pat. No. 4,362,613 is incorporated herein by reference.

The membrane separation operating conditions in terms of flow rate (number and size of membrane separator units employed), pressure and pressure drop are preferably adjusted to achieve at least 90, more preferably at least 95, volume percent recovery of the hydrogen from the hydrogen-rich gas fed to the separation step via line 28, and to achieve at least 95, more preferably at least 98, volume percent hydrogen purity for the purified hydrogen withdrawn via lie 30.

We have found that use of membrane separation in zone 29 provides more advantageous results than pressure swing adsorption, particularly in terms of hydrogen gas savings; overall investment costs; ease of handling further processing, if needed, for the rejected impurity gases due to their higher exit pressure from membrane separation than from pressure swing adsorption, and ease of operating and maintaining the overall process for separating gases and liquids from the hydroconversion zone effluents.

In the preferred embodiment wherein two cold low pressure separation zones are used, the liquid phase from cold high pressure zone 14 is passed to cold low pressure separation zone 17. In zone 17 a separation is effected and a gas phase is withdrawn via line 32 for further processing and a liquid phase via line 33 for further processing, such as distillation into hydrocarbon product streams.

When the second cold low pressure separation step is not included in the process, the liquid from cold high pressure separation in line 16 can be passed to further processing such as distillation, but preferably is combined with the gas phase from zone 12 for separation in cold low pressure separation zone 20.

Separation operations in accordance with U.S. Pat. No. 4,457,834, discussed above, may give some advantages in terms of hydrogen purity in the recycle gas, and reduced investment in certain of the pressurized vessels. The present process affords advantages in terms of relatively high energy efficiency, generally lower hydrogen losses, lower investment cost and increased reliability. Increased reliability of the process of the present invention is based in part on not loading-up the make up hydrogen compressor as much in the current process as in a process where the hydrogen pressure is let-down to low levels as in U.S. Pat. No. 4,457,834. Also, in the present process the centrifugal recycle compressor is less susceptible to down time than the reciprocating make up compressor. The present process has a relatively high reliability for availability of recycle hydrogen gas, which is critical to operation of the hydroconversion zone. In the present process the pressure swing adsorption step affords advantages in terms of hydrogen purity, but yet the pressure swing adsorption system may be disengaged from the flow system and operation of the recycle stream and hydroconversion zone continued.

Energy-efficient operation of the process depicted in FIG. 1 will include recovery of the heat removed from the overhead streams from the hot high pressure separation zone and hot low pressure separation zone and power recovery from streams being converted from high to low pressure. Conventional equipment such as heat exchangers and turbines may be used to recover this energy from the process.

EXAMPLE

The following example contains calculated comparisons for several cases versus the present invention, particularly a preferred embodiment of the present invention wherein membrane separation is used in the hydrogen purification step. The various cases are compared in Table 1 below on bases of investment, utilities cost and hydrogen savings. Base case absolute numbers are not listed as the comparisons are all made on a relative basis.

The comparisons were made against a Base Case hydrodesulfurization process wherein impurities were not removed from the system by withdrawal of a portion of the recycled hydrogen gas. Instead, a somewhat higher total pressure was used; the impurities, such as methane, were allowed to build up in the system so that they would exit as dissolved gases in the liquid streams withdrawn from the process, the partial pressure of hydrogen in the hydrodesulfurization reaction zone was allowed to tail off from about 2,000 to 1,800 psig from Start of Run (SOR) to End of Run (EOR); and there was no recycle from the cold low pressure separator. The feed for the example was a reduced crude containing over two weight percent sulfur, over 20 ppm by weight metals, and having a boiling range mostly above 650° F. The feed rate was approximately 28,000 barrels per day, hydroconversion reactor conditions were 730°/780° F. inlet/outlet temperature for SOR, 750°/800° F. inlet/outlet temperature for EOR, inlet pressure of about 2,500 psig, and total hydrogen gas feed rate of about 6,500 Standard Cubic Feet per barrel of feed.

For the preferred embodiment of the "Present Process" listed in Table 1, the temperature and pressure in the various separation steps was as follows: hot high pressure separator 700° F., 2,250 psig; cold high pressure separator 120° F., 2,230 psig; hot low pressure separator 700° F., 380 psig; cold low pressure separator (2) 120° F., 330 psig; cold low pressure separator 120° F., 130 psig.

For the case illustrating U.S. Pat. No. 4,457,834, substantially similar basic operating conditions were used as in the Present Process case except that the flow scheme as in U.S. Pat. No. 4,457,834 was followed Amongst other factors, the '834 process results in low pressure (approximately 100–300 psig) hydrogen from the hydrogen purification step (zone 54 in the drawing of the '834 patent).

For the Naphtha Wash case in Table 1 substantially similar basic operating conditions were used as in the Present Process case.

Referring to the Table 1 results for the comparative study of the four cases, it is seen that the Present Process showed a large advantage in terms of hydrogen savings. Namely, a savings of 80 SCF (measured at 60° F. and 1 atmosphere pressure) of hydrogen per barrel of oil feed to the hydrodesulfurization unit compared to the Base Case. This savings is worth over $5,000 per day compared to the Base Case. The hydrogen savings was almost quadruple that of the Low Pressure Case (the '834 patent): 80 SCF/BBL versus 21 SCF/BBL savings over Base Case, and the savings for the Present Process was more than double that of the Naphtha Wash Case: 80 SCF/BBL versus 35 SCF/BBL savings over Base Case.

Also, the Present Process was found to be more energy efficient than the other cases, as the net operating savings indicate. The net operating savings derive primarily from reduced hydrogen and utilities requirements for the Present Process versus the other three cases.

TABLE 1

| | Base Case | Present Process | Low Pressure U.S. Pat. No. 4,457,834 | Naphtha Wash |
|---|---|---|---|---|
| INVESTMENT, $MM | | | | |
| Reactors | — | (0.82) | (0.82) | (0.82) |
| High Pressure Loop | — | (0.50) | 14.00 | (0.50) |
| Other | — | 1.13 | (4.57) | 2.34 |
| Utilities, $/Day | | | | |
| Pumps | — | (61) | (624) | 158 |
| Recycle Compressor | — | 131 | (5060) | 425 |
| Steam Power to M/U Compressor | — | 1071 | 15861 | — |
| Fuel | — | 33 | 33 | 33 |
| Total | — | 1174 | 10210 | 616 |
| HYDROGEN SAVINGS | | | | |
| SCF/Bbl | — | 80 | 21 | 35 |
| $/Day | — | 5540 | 1454 | 2424 |
| SUMMARY | | | | |
| Net Investment, $MM | — | (0.19) | 8.61 | 1.02 |
| Net Operating Savings, $/Day | — | 4366 | (8756) | 1808 |
| Payout, Years | — | | | 1.5 |

Modifications of the process, shown in the drawings and described above, that are obvious to those of ordinary skill in the refinery process art, are intended to be within the scope of the invention.

What is claimed is:

1. A process for separating gases from a hydroconversion zone reaction effluent comprising:

(a) effecting a hot high pressure separation of the effluent by reducing the temperature of the effluent to produce a first gas phase comprising hydrogen, contaminant gases, and gaseous hydrocarbons and a first liquid phase comprising hydrocarbons, and separating the first gas phase from the first liquid phase;

(b) effecting a cold high pressure separation of the first gas phase by reducing the temperature of the first gas phase to form a first hydrogen-rich gas product and a second liquid phase, and separating the second liquid phase from the first hydrogen-rich gas;

(c) effecting a hot low pressure separation of the first liquid phase by reducing the pressure of the first liquid phase to form a second gas phase comprising hydrogen and gaseous hydrocarbons and a third liquid phase comprising hydrocarbons, and separating the second gas phase from the third liquid phase;

(d) effecting a cold low pressure separation of the second gas phase by reducing the temperature thereof to form a second hydrogen-rich and a fourth liquid phase comprising hydrocarbons, and separating the fourth liquid phase from the second hydrogen-rich gas;

(e) recycling the second hydrogen-rich gas to the hydroconversion zone;

(f) subjecting said first hydrogen-rich gas product to the removal of contaminants comprising $H_2S$ to produce a hydrogen-rich, contaminant-removal treated gas and recycling a first portion of said hydrogen-rich, contaminant-removal treated gas to the hydroconversion zone;

(g) purifying a second portion of said hydrogen-rich, contaminant-removal treated gas to obtain a purified hydrogen-rich gas of at least 95 volume percent hydrogen, wherein the purification is carried out using membranes to separate the purified hydrogen-rich gas from the first hydrogen-rich gas; and (h) recycling the purified hydrogen-rich gas to the hydroconversion zone.

2. A process in accordance with claim 1 further comprising: (i) effecting a second cold low pressure separation by reducing the pressure of the second liquid phase to form a third gas phase comprising contaminant gases and gaseous hydrocarbons, and a fifth liquid phase comprising hydrocarbons; and separating the third gas phase from the fifth liquid phase.

3. A process in accordance with claim 2 wherein the hydrogen content of the first hydrogen-rich gas is at least about 75% by volume.

4. A process in accordance with claim 3 wherein the hydrogen content of the first hydrogen-rich gas is at least about 80 percent by volume.

5. A process in accordance with claim 1 wherein hydrotreating is carried out in the hydroconversion zone, the feed to the hydroconversion zone is a heavy oil boiling mostly above 650° F., the hydroconversion zone is operated at a temperature above 700° F. and the hydroconversion reaction zone effluent is cooled to a temperature between 750° F. and 650° F. prior to separating the first gas from the first liquid phase.

6. A process in accordance with claim 5 wherein the temperature at which the step (a) separation is affected and the temperature at which the step (b) separation is affected are adjusted to obtain at least 80 volume percent hydrogen content for the first hydrogen-rich gas.

7. A process in accordance with claim 6 wherein the temperature at which the step (a) separation is effected is 675° F. to 725° F.

8. A process in accordance with claim 1 wherein the temperature of the effluent is reduced to between about 400° F. and 750° F. in step (a); the temperature of the first gas phase is reduced to between about 90° F. and 200° F. in step (b); the pressure of the first liquid phase is reduced to between about 100 psig and 1000 psig in step (c); and the temperature of the second gas phase is reduced to between about 90° F. and 200° F. in step (d).

9. A process in accordance with claim 1 wherein the membrane separation is carried out using hollow fiber membranes.

* * * * *